US009981818B2

(12) United States Patent
Kumakura et al.

(10) Patent No.: US 9,981,818 B2
(45) Date of Patent: May 29, 2018

(54) IMAGE FORMING APPARATUS

(71) Applicant: CANON KABUSHIKI KAISHA, Tokyo (JP)

(72) Inventors: Nozomi Kumakura, Toride (JP); Seita Inoue, Kashiwa (JP); Kunio Takane, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/352,954

(22) Filed: Nov. 16, 2016

(65) Prior Publication Data

US 2017/0176912 A1 Jun. 22, 2017

(30) Foreign Application Priority Data

Dec. 16, 2015 (JP) ..... 2015-245178

(51) Int. Cl.

*B65H 7/06* (2006.01)
*B65H 5/06* (2006.01)
*G03G 15/00* (2006.01)

(52) U.S. Cl.

CPC ..... *B65H 7/06* (2013.01); *B65H 5/062* (2013.01); *G03G 15/70* (2013.01); *B65H 2511/528* (2013.01); *B65H 2601/11* (2013.01); *B65H 2601/255* (2013.01); *G03G 2215/00341* (2013.01); *G03G 2215/00548* (2013.01)

(58) Field of Classification Search

CPC ..... B65H 5/062; B65H 7/06; G03G 2215/00341; G03G 2215/00548; G03G 2215/1675; G03G 15/70

See application file for complete search history.

(56) References Cited

U.S. PATENT DOCUMENTS

| | | | | |
|---|---|---|---|---|
| 3,992,557 | A | 11/1976 | Kubo et al. | |
| 4,484,070 | A | 11/1984 | Inoue | |
| 4,618,251 | A | 10/1986 | Yanagawa et al. | |
| 7,547,010 | B2 * | 6/2009 | Yokobori | G03G 15/5012 271/176 |
| 7,805,087 | B2 * | 9/2010 | Sunada | G03G 15/6573 399/18 |
| 9,291,971 | B2 * | 3/2016 | Tashiro | G03G 15/657 |
| 9,682,836 | B2 * | 6/2017 | Kowase | B65H 29/60 |

(Continued)

FOREIGN PATENT DOCUMENTS

JP 2010-070288 A 4/2010

*Primary Examiner* — Patrick Cicchino

(74) *Attorney, Agent, or Firm* — Fitzpatrick, Cella, Harper & Scinto

(57) ABSTRACT

An image forming apparatus including: a sheet container; a sheet conveyer; a sheet detector; and a controller, wherein, in a case where a leading edge of a first sheet is positioned downstream of a first position in a conveyance direction and a trailing edge of a second sheet preceding the first sheet is positioned downstream of a second position located downstream of the first position when the first and second sheets are stopped based on a result of the sheet detector, the controller causes the sheet conveyer to convey the first sheet in the conveyance direction, and in a case where the leading edge of the first sheet is positioned upstream of the first position when the first and second sheets are stopped, the controller causes the sheet conveyer to convey the first sheet in an opposite direction to return the first sheet to the sheet container.

9 Claims, 9 Drawing Sheets

(56) References Cited

U.S. PATENT DOCUMENTS

| | | | | |
|---|---|---|---|---|
| 2006/0147220 | A1* | 7/2006 | Seo | G03G 15/5012 399/21 |
| 2009/0226193 | A1* | 9/2009 | Muratani | G03G 15/6573 399/21 |
| 2014/0212153 | A1* | 7/2014 | Tanaka | G03G 15/70 399/18 |
| 2014/0241737 | A1* | 8/2014 | Shirasaka | G03G 15/6552 399/20 |
| 2016/0154364 | A1* | 6/2016 | Kamata | G03G 15/70 399/21 |
| 2017/0160695 | A1* | 6/2017 | Nakabayashi | G03G 15/70 |

* cited by examiner

IMAGE FORMING APPARATUS

BACKGROUND OF THE INVENTION

Field of the Invention

The present invention relates to an image forming apparatus.

Description of the Related Art

Hitherto, the following image forming apparatus exists. Specifically, when a currently conveyed sheet is jammed and cannot be conveyed any more, the image forming apparatus stops all the currently conveyed sheets including the sheet causing the sheet jam and displays an operation guidance for jam removal so as to urge a user to cope with the sheet jam.

However, a sheet without damage such as a fold, which has not been subjected to image formation with a toner, is required to be removed by the user when the sheet jam occurs even though the sheet is reusable. As a result, there arises a problem in that the usable sheet is wasted.

In view of the problem described above, the following technology has been proposed. According to the technology, when the sheet jam occurs, a reusable sheet that is closer to a sheet feeding device than the jammed sheet and has not been subjected to the image formation is returned to the sheet feeding device by reverse rotation of conveyance rollers (Japanese Patent Application Laid-Open No. 2010-070288).

When the sheet is returned to the sheet feeding device, however, the returned sheet is sometimes damaged depending on the amount of return of the sheet or a configuration of the conveyance rollers configured to return the sheet. For example, it is assumed that the sheet fed from the sheet feeding device is stopped in a state in which a center portion of the sheet is nipped between rollers of a sheet feeding roller pair and a leading edge of the sheet is nipped between rollers of the conveyance roller pair provided downstream of the sheet feeding roller pair when the sheet jam occurs. The sheet feeding roller pair can rotate reversely to convey the sheet in a direction of returning the sheet to the sheet feeding device. However, the conveyance roller pair provided downstream of the sheet feeding roller pair cannot rotate reversely so as to convey the sheet in the direction of returning the sheet to the sheet feeding device. Therefore, when the sheet feeding roller pair is rotated reversely so as to convey the sheet in the direction of returning the sheet to the sheet feeding device in a state in which the sheet is nipped between the rollers of the sheet feeding roller pair and the rollers of the conveyance roller pair provided downstream of the sheet feeding roller pair, a roller mark of the conveyance roller pair is sometimes left on the sheet. When the sheet damaged with the roller mark is used for the image formation, there is a possibility of occurrence of an image defect or conveyance failure.

SUMMARY OF THE INVENTION

In view of the above-mentioned problem, the present invention provides an image forming apparatus configured to prevent a damaged sheet from being used for image formation.

In order to solve the above-mentioned problem, according to one embodiment of the present invention, there is provided an image forming apparatus, comprising:

a sheet container configured to contain a sheet;

an image forming portion configured to form an image on the sheet;

a sheet conveyer configured to convey the sheet in a conveyance direction from the sheet container to the image forming portion on a conveyance path between the sheet container and the image forming portion;

a sheet detector configured to detect the sheet on the conveyance path; and a controller configured to control conveyance of the sheet, wherein, in a case where a leading edge of a first sheet is positioned downstream of a first predetermined position on the conveyance path in the conveyance direction and a trailing edge of a second sheet preceding the first sheet is positioned downstream of a second predetermined position located downstream of the first predetermined position when the controller causes the sheet conveyer to stop conveyance of a first sheet and a second sheet based on a detection result of the sheet detector, the controller controls the sheet conveyer so that the first sheet is conveyed in the conveyance direction by the sheet conveyer, and wherein, in a case where the leading edge of the first sheet is positioned upstream of the first predetermined position when the controller causes the sheet conveyer to stop the conveyance of the first sheet and the second sheet based on the detection result of the sheet detector, the controller controls the sheet conveyer so that the first sheet is conveyed in a direction opposite to the conveyance direction by the sheet conveyer so as to be returned to the sheet container.

Further features of the present invention will become apparent from the following description of exemplary embodiments with reference to the attached drawings.

DESCRIPTION OF THE EMBODIMENTS

Now, modes for carrying out the present invention will be described referring to the accompanying drawings.

(Image Forming Apparatus)

Figure 1:
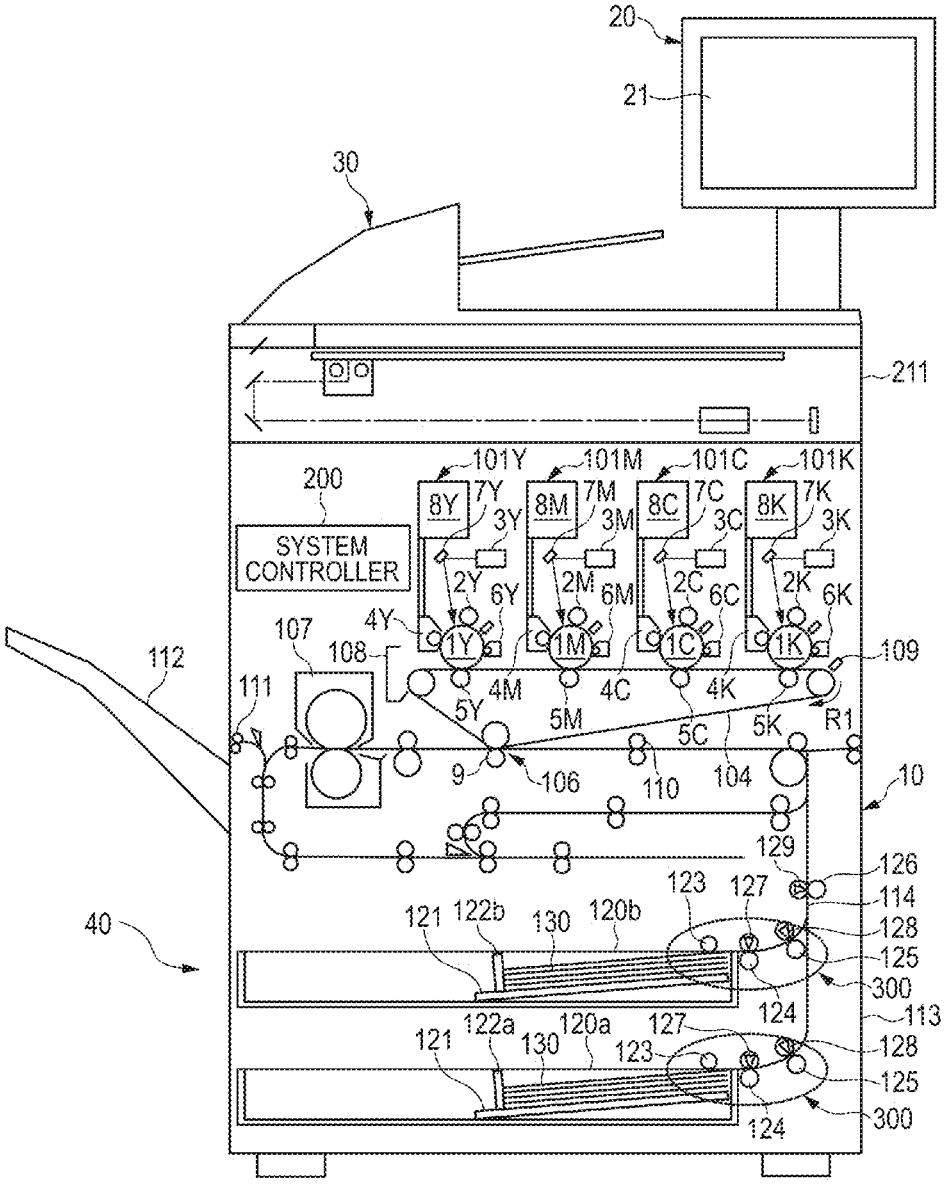
FIG. 1 is a sectional view of an image forming apparatus.

FIG. 1 is a sectional view of an image forming apparatus 10. The image forming apparatus 10 includes four image forming portions 101 (101Y, 101M, 101C, and 101K). The image forming portion 101Y is configured to form a yellow image by using a yellow toner. The image forming portion 101M is configured to form a magenta image by using a magenta toner. The image forming portion 101C is configured to form a cyan image by using a cyan toner. The image forming portion 101K is configured to form a black image by using a black toner. The letters Y, M, C, and K in the reference symbols illustrated in FIG. 1 respectively denote yellow, magenta, cyan, and black. The four image forming portions 101 have the same structure except for colors of developers (toners). Therefore, the letters Y, M, C, and K are omitted from the reference symbols in the following description unless particularly needed.

Each of the image forming portions 101 includes a photosensitive drum (image bearing member) 1 as a photosensitive member. A charging device 2, a light scanning device 3, a developing device 4, a primary transfer device 5, and a cleaning device 6 are provided around the photosensitive drum 1. The four photosensitive drums 1Y, 1M, 1C, and 1K are arranged in a row at predetermined intervals. An endless intermediate transfer belt (hereinafter referred to as "intermediate transfer member") 104 is provided under the photosensitive drums 1. The intermediate transfer member 104 is rotated in a direction indicated by the arrow R1.

An image forming operation performed by the image forming apparatus 10 will be described. An image reading portion (scanner unit) 211 provided under an automatic original feeding device 30 is configured to read an image of an original to generate an image signal. The image signal output from the image reading portion 211 is input to the light scanning device 3. Further, also when the image signal is generated based on a job instruction from an operation display device (hereinafter referred to as "operating portion") 20 or an external device, e.g., a personal computer (hereinafter referred to as "PC"), the image signal is input to the light scanning device 3.

The charging device 2 is configured to uniformly charge a surface of the photosensitive drum 1. The light scanning device 3 is configured to emit laser light (hereinafter referred to as "light beam") modulated based on the image signal. The light scanning device 3 is configured to deflect the light beam so that the uniformly charged surface of the photosensitive drum 1 is scanned with the light beam. The deflected light beam is reflected by a reflecting mirror 7 to be radiated on the photosensitive drum 1. As a result, an electrostatic latent image is formed on the photosensitive drum 1. The electrostatic latent image formed on the photosensitive drum 1 is developed by the developing device 4 with the toner into a toner image. The toner image formed on the photosensitive drum 1 is transferred onto the intermediate transfer member 104. The toner images of the respective colors are transferred from the four photosensitive drums 1 onto the intermediate transfer member 104 respectively at predetermined timings so as to be overlapped with each other.

A plurality of sheet feeding cassettes (hereinafter referred to as "sheet containers") 120 (120*a*, 120*b*) configured to contain sheets as recording media are provided in a lower part of the image forming apparatus 10. The sheet containers 120 are mounted in the image forming apparatus 10 so as to be removable from the image forming apparatus 10. A sheet deck may be provided as a sheet container configured to contain the sheets in place of or together with the sheet feeding cassettes. The sheet fed from each of the sheet containers 120 passes through a conveyance path 114 to be conveyed to a registration roller pair 110. A leading edge of the sheet comes into abutment against the stopped registration roller pair 110 so that skew feed of the sheet is corrected. The registration roller pair 110 is driven at predetermined timing. The registration roller pair 110 conveys the sheet to a secondary transfer portion 106 formed between the intermediate transfer member 104 and a secondary transfer roller 9, at timing in synchronization with timing of the toner images formed on the intermediate transfer member 104. The toner images overlapped with each other on the intermediate transfer member 104 are transferred onto the sheet by the secondary transfer roller 9 at the secondary transfer portion 106. Meanwhile, the toners remaining on the intermediate transfer member 104 after the secondary transfer are removed by an intermediate transfer member cleaning portion 108.

The sheet onto which the toner images have been transferred is conveyed to a fixing portion 107. In the fixing portion 107, the toner images on the sheet are heated and pressurized to be fixed onto the sheet. In this manner, a color image is formed on the sheet. The sheet on which the image is formed is delivered out of the image forming apparatus 10 by a delivery portion 111 to be stacked on a stacking tray 112.

A conveyance path opening and closing door (hereinafter referred to simply as "door") 113 configured to open and close the conveyance path 114 is openably and closably provided in the image forming apparatus 10. The door 113 is provided in the vicinity of the conveyance path (vertical conveyance path) 114 extending in a vertical direction along a side surface of the image forming apparatus 10. The conveyance path 114 can be opened by opening the door 113. When the sheet jam occurs, a user can perform processing (jam removal) of removing the sheet on the conveyance path 114 while viewing the conveyance path 114 by opening the door 113.

(Sheet Feeding Portion)

A sheet feeding portion 40 includes the sheet containers 120 (120*a*, 120*b*) and retard-system sheet feeding drive portions 300. In the retard system, a retard roller 124*a* (FIG. 2A) is configured to prevent double feeding of the sheets by rotating at a predetermined torque in a direction of returning the sheet conveyed by a feed roller 124*b*. Further, when the sheets are supplied to any one of the sheet containers 120, the corresponding sheet container 120 is pulled out of the image forming apparatus 10 to supply the sheets. At this time, the corresponding sheet feeding drive portion 300 remains inside the image forming apparatus 10 without being pulled together with the sheet container 120. Each of frames 122 (122*a*, 122*b*) of the sheet containers 120 is located at the same height as a sheet feeding sensor (sheet detector) 127 for the corresponding sheet container 120. Therefore, the sheet is required to be absent on the sheet detecting sensor 127 when the sheet container 120 is pulled out.

(Sheet Feeding Drive Portion)

Figure 2A:
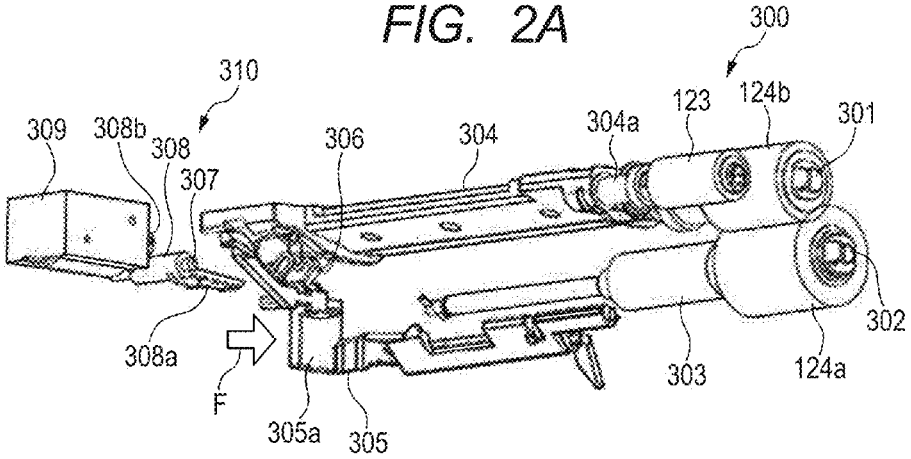
FIGS. 2A, 2B and 2C are perspective views of a sheet feeding drive portion.
Figure 2B:
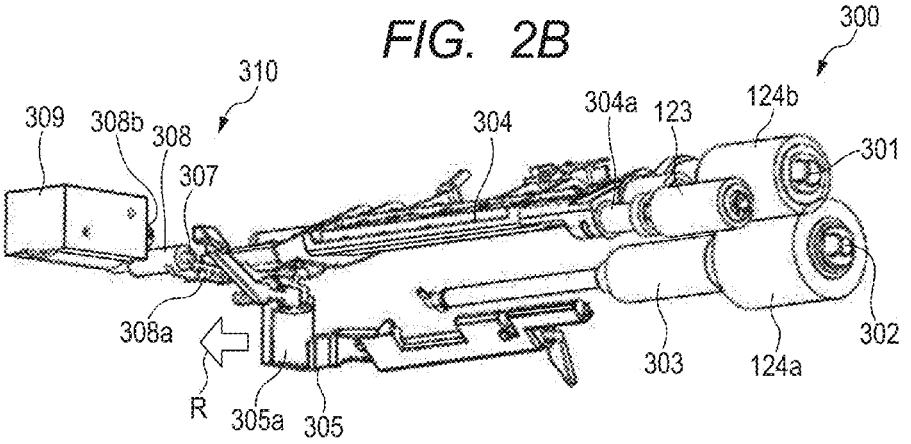
Figure 2C:
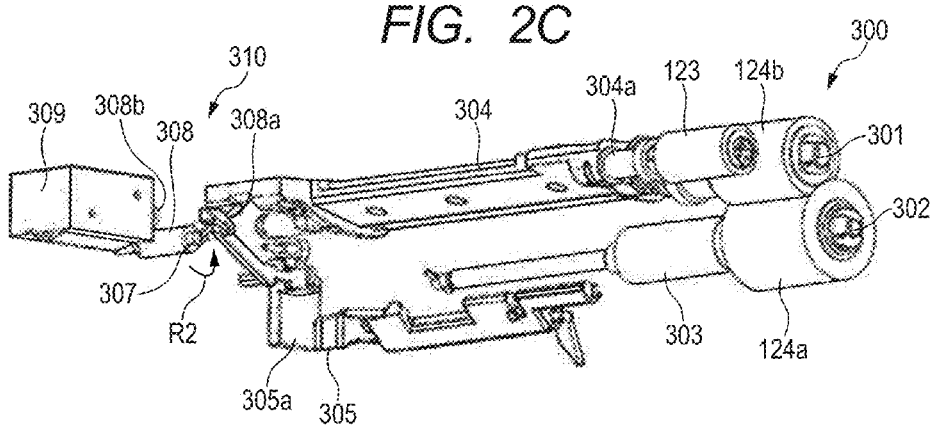

Next, the sheet feeding drive portion 300 will be described. FIG. 2A, FIG. 2B, and FIG. 2C are perspective views of the sheet feeding drive portion 300. First, referring to FIG. 2A to FIG. 2C, movement of the sheet feeding drive portion 300 along with mounting and removal of the sheet container 120 will be described. FIG. 2A is a view for illustrating the sheet feeding drive portion 300 when the sheet container 120 is pulled out. A releasing member 305 is provided so as to be freely slidable in a forward direction F and a rearward direction R of the image forming apparatus 10. The releasing member 305 is urged in the forward direction F by a spring (not shown) serving as an urging member. An arm member 306 is turnably supported on a casing 330 (FIG. 4A) configured to house the sheet feeding drive portions 300. A pickup roller holder 304 is rockable about a feed roller shaft 301. A pickup roller 123 is rotatably held on a rocking end portion 304*a* which is distant from a rocking center (feed roller shaft 301) of the pickup roller holder 304. When the sheet container 120 is pulled out, the releasing member 305 is moved in the forward direction F to turn the arm member 306 upward. As a result, the arm member 306 holds the pickup roller holder 304 and the pickup roller 123 in upper retreated positions.

Figure 3:
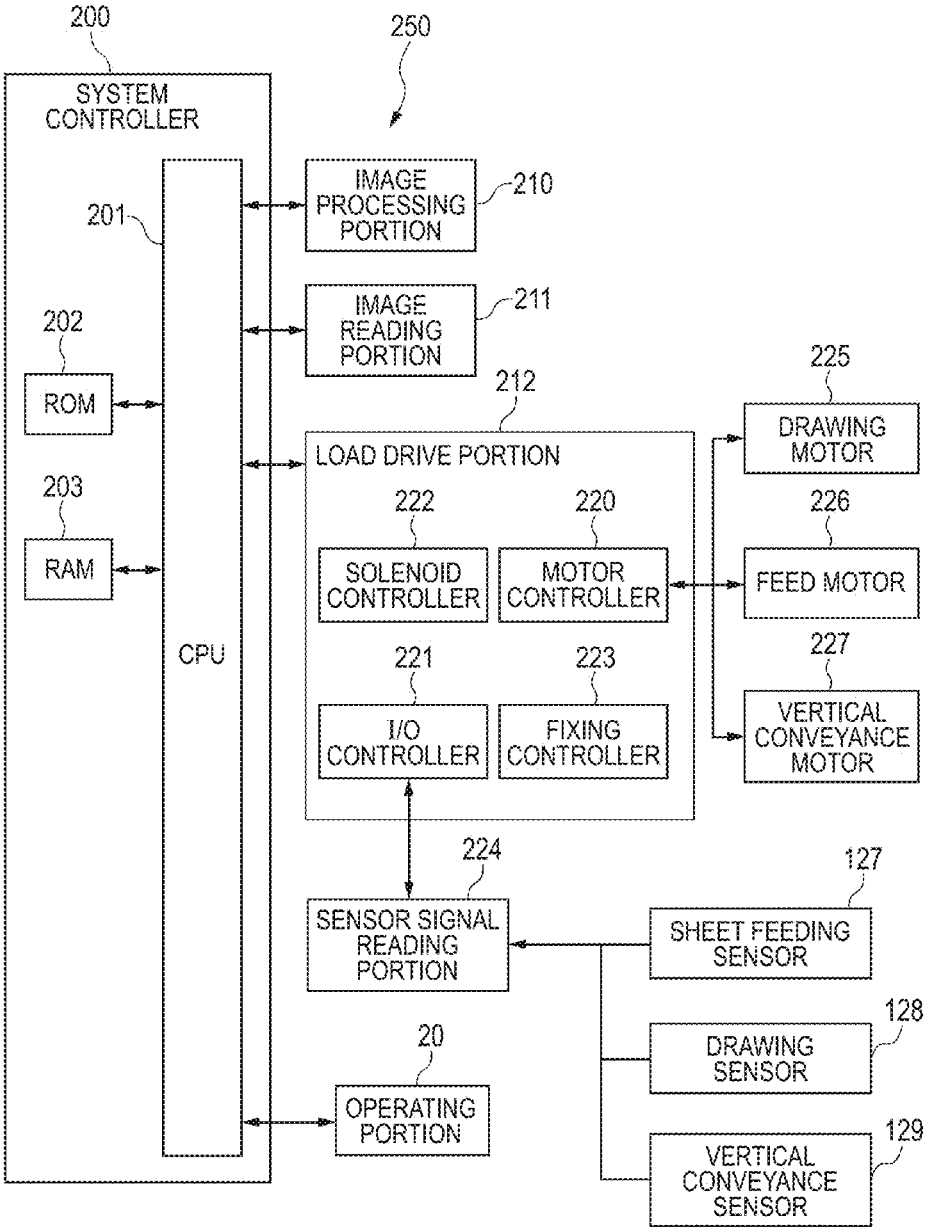
FIG. 3 is a block diagram of a control system of the image forming apparatus.

A sheet feeding roller pair 124 serving as a conveyance portion includes the retard roller 124*a* and the feed roller 124*b*. The retard roller 124*a* and a torque limiter 303 are provided on a retard roller shaft 302. The pickup roller 123, the retard roller 124*a*, and the feed roller 124*b* are rotated by a driving force of a feed motor 226 (FIG. 3). The pickup roller 123 and the feed roller 124*b* are rotated in a conveyance direction of feeding the sheet. The driving force of the feed motor 226 is transmitted so that the retard roller 124*a* is rotated in a direction of conveying the sheet in a direction opposite to the conveyance direction of the feed roller 124*b*. The retard roller 124*a* and the feed roller 124*b* are supported so as to be held in pressure-contact with each other at a predetermined pressure (pressure-contact force of 300 gf in the embodiment) when the sheet is fed.

Next, a link operation performed when the sheet container 120 is mounted will be described referring to FIG. 2B. FIG. 2B is a view for illustrating the sheet feeding drive portion 300 when the sheet container 120 is mounted. When the sheet container 120 is pushed into the image forming apparatus 10, the sheet container 120 comes into abutment against an abutment portion 305*a* of the releasing member 305. The releasing member 305 is moved in the rearward direction R to turn the arm member 306 downward. As a result, the pickup roller holder 304 rocks downward, and the pickup roller 123 is also moved downward from the upper retreated position. A lowermost position of the pickup roller 123 at this time is set to a position at which the pickup roller 123 can come into abutment against an uppermost surface of a bundle of sheets 130 with a sufficient margin quantity during a sheet feeding operation described later. Further, the pickup roller holder 304 is urged downward by a spring (not shown) serving as an urging member, and is set so that a proper pickup pressure (125 gf in the embodiment) is generated at the time of abutment against the uppermost surface of the bundle of sheets 130.

Next, a moving unit 301 configured to move the pickup roller 123 upward during the sheet feeding operation will be described referring to FIG. 2C. FIG. 2C is a view for illustrating the sheet feeding drive portion 300 when the pickup roller 123 is moved upward by the moving unit 310. The moving unit 310 includes a solenoid 309 and a link member 308. The solenoid 309 includes an iron core (not shown) moving in a reciprocating manner. The link member 308 is supported by a shaft 307 so as to be rotatable. The link member 308 includes an action arm 308*a* configured to act on the rocking end portion of the pickup roller holder 304 and an arm portion 308*b* coupled to an iron core (not shown) of the solenoid 309. When the solenoid 309 is energized at desired timing during the sheet feeding operation, the iron core (not shown) is pulled inside to turn the link member 308 through intermediation of the arm portion 308*b* in a direction indicated by the arrow R2. As a result, the action arm 308*a* of the link member 308 is turned upward. By the action arm 308*a*, the pickup roller holder 304 and the pickup roller 123 are rocked upward. The moving unit 310 may use another drive device, e.g., a motor in place of the solenoid 309.

(Control System)

Next, a control system 250 of the image forming apparatus 10 will be described referring to FIG. 3. FIG. 3 is a block diagram of the control system 250 of the image forming apparatus 10. The control system 250 includes a system controller 200, an image processing portion 210, the image reading portion 211, a load drive portion 212, and the operating portion 20. The system controller 200 includes a CPU 201, a ROM 202, and a RAM 203. The CPU 201 is connected to the ROM 202, the RAM 203, the image processing portion 210, the image reading portion 211, and the load drive portion 212 by buses. Further, the CPU 201 is connected to the operating portion 20. The load drive portion 212 includes a motor controller 220, an I/O controller 221, a solenoid controller 222, and a fixing controller 223. The motor controller 220 is electrically connected to a drawing motor 225, a feed motor 226, and a vertical conveyance motor 227. The I/O controller 221 is electrically connected to a sensor signal reading portion 224. The sensor signal reading portion 224 is electrically connected to a sheet feeding sensor 127, a drawing sensor 128, and a vertical conveyance sensor 129, each serving as a sheet detector.

The image forming apparatus 10 is comprehensively controlled by the system controller 200. The system controller 200 is configured to control the load drive portion 212 configured to drive various loads including the drawing motor 225, the feed motor 226, and the vertical conveyance motor 227. The system controller 200 is configured to collect and analyze information from various sensors including the sheet feeding sensor 127, the drawing sensor 128, and the vertical conveyance sensor 129. Further, the system controller 200 is configured to exchange data with the image processing portion 210 and the operating portion (user interface) 20. The system controller 200 is configured to control the conveyance of the sheets.

The CPU 201 built in the system controller 200 is configured to execute various sequences associated with a predetermined image formation sequence by a program stored in the ROM 202 built in the system controller 200. The system controller 200 also has the RAM 203 built therein so as to store rewritable data required to be temporarily or permanently stored in the RAM 203 during the execution of the sequence. The RAM 203 stores, for example, image formation instruction information from the operating portion 20. The system controller 200 is configured not only to transmit, to the image processing portion 210, specification setting value data of the respective portions, which are necessary for image processing, but also to receive signals from the respective portions, for example, an original image density signal, to thereby control the image processing portion 210 to perform setting for optimal image formation.

For the operating portion 20, the system controller 200 is configured to obtain information including a copy magnification and a density setting value set by the user from the operating portion 20. Further, the system controller 200 is configured to transmit information indicating a state of the image forming apparatus 10, for example, the number of formed images and whether or not the image formation is being performed, and data for informing the user of occurrence of the sheet jam, and a location where the sheet jam occurs, to the operating portion 20.

Next, a basic operation of the system controller 200 during the image forming operation will be described. When a print instruction is input through the operating portion 20 or the PC (not shown), the CPU 201 determines the print job to be executed, stores print job information, and further display corresponding information on a display portion 21 of the operating portion 20. Further, the CPU 201 instructs the load drive portion 212 to comprehensively control the motor controller 220, the solenoid controller 222, the I/O controller 221, and the fixing controller 223. The motor controller 220 is configured to control a sheet conveyer including the sheet feeding roller pair (sheet feeding conveyance portion) 124, a drawing roller pair (drawing conveyance portion) 125, and a vertical conveyance roller pair (vertical conveyance portion) 126. The solenoid controller 222 is configured to control the solenoid 309. The sensor signal reading portion 224 is configured to read signal values (data) from the sheet feeding sensor 127, the drawing sensor 128, and the vertical conveyance sensor 129. The I/O controller 221 is configured to transmit and receive a signal to/from the sensor signal reading portion 224.

(Sheet Feeding Operation and Sheet Return Operation)

Figure 4A:
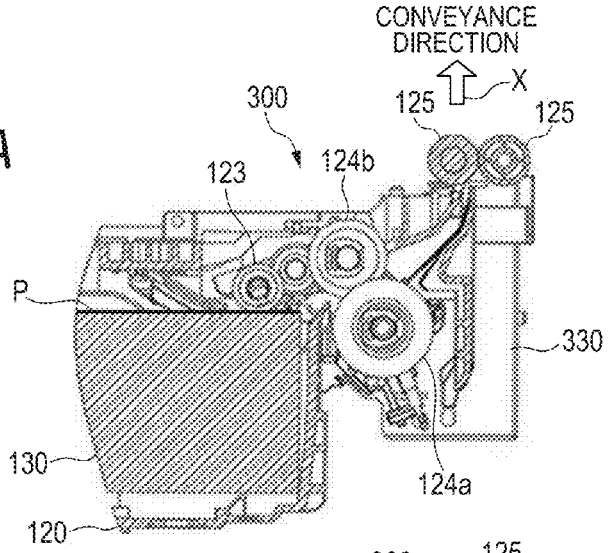
FIGS. 4A, 4B and 4C are sectional views of the sheet feeding drive portion.
Figure 4B:
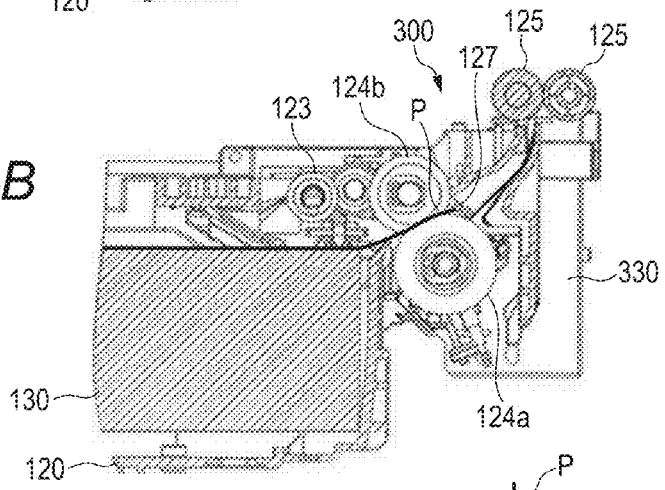
Figure 4C:
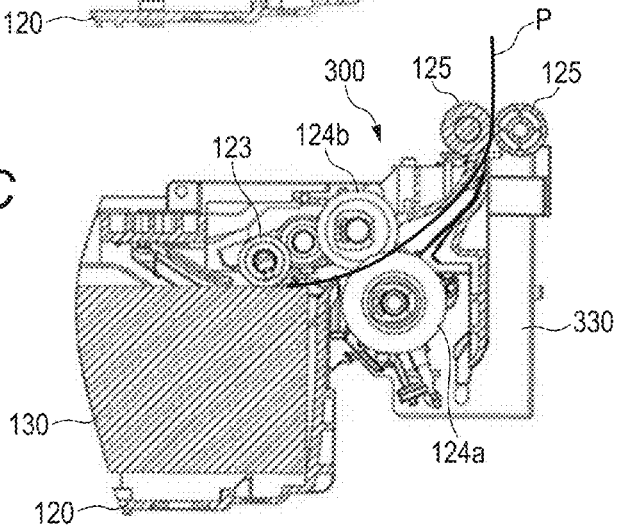

Next, a sheet feeding operation and a sheet return operation after the occurrence of the sheet jam are described referring to FIG. 4A, FIG. 4B, and FIG. 4C. FIG. 4A to FIG. 4C are sectional views of the sheet feeding drive portion 300. After the bundle of sheets 130 is loaded into the sheet container 120 and the sheet container 120 is mounted in the image forming apparatus 10, the pickup roller 123 is moved down from the upper retreated position to a position at which the pickup roller 123 can come into abutment against the uppermost surface of the bundle of sheets 130. At the same time, a lifter 121 provided to a bottom portion of the sheet container 120 lifts up the bundle of sheets 130 to bring the uppermost surface of the bundle of sheets 130 into abutment against the pickup roller 123.

After the sheet feeding operation is started, drive of the feed motor 226 is first started to rotate the pickup roller 123 and the feed roller 124*b* in a conveyance direction X at a rotation speed V. The retard roller 124*a* is driven so as to be rotated in a direction opposite to the conveyance direction X. Due to action of the torque limiter 303, the retard roller 124*a* is rotated in the conveyance direction X along with the rotation of the feed roller 124*b* being in contact with the retard roller 124*a* or along with the movement of a sheet P. When a plurality of sheets are fed by the pickup roller 123, the retard roller 124*a* being in contact with the sheet other than the uppermost sheet is rotated in the direction opposite to the conveyance direction X to sequentially return the sheets being in contact with the retard roller 124*a*, thereby separating the sheets one by one.

The sheet feeding sensor 127 is provided at a position where the sheet feeding roller pair 124 (124*a*, 124*b*) is located or at a position downstream of the sheet feeding roller pair 124 in the conveyance direction X for the sheet P. In the following description, the detection of the sheet by the sheet feeding sensor 127 at the position of the sheet feeding roller pair 124 encompasses the detection of the sheet by the sheet feeding sensor 127 at the position downstream of the sheet feeding roller pair 124. When a leading edge of the fed sheet P reaches a position of the sheet feeding sensor 127 (FIG. 4B), the sheet feeding sensor 127 outputs a detection signal indicative of the detection of the sheet P. The CPU 201 energizes the solenoid 309 in accordance with the detection signal from the sheet feeding sensor 127. The solenoid 309 turns the action arm 308*a* upward to move the pickup roller 123 upward. The pickup roller 123 is separated away from the surface of the sheet P. The pickup roller 123 is moved upward so as to prevent a subsequent sheet from being fed together with the preceding one (double-fed).

Further, simultaneously with the start of drive of the feed motor 226, drive of the drawing motor 225 is started. The drawing roller pair 125 serving as the conveyance portion is also rotated in the conveyance direction X at the rotation speed V. After the leading edge of the sheet P fed by the sheet feeding roller pair 124 is nipped between rollers of the drawing roller pair 125, the sheet P is conveyed by the sheet feeding roller pair 124 and the drawing roller pair 125. The drawing roller pair 125 is a conveyance roller pair configured to nip the leading edge of the fed sheet P before a trailing edge of the sheet P passes through the sheet feeding roller pair 124 to convey the sheet P on the conveyance path 114 in cooperation with the sheet feeding roller pair 124. The sheet P is conveyed on the conveyance path 114 to be conveyed to the image forming portion 101 by the vertical conveyance roller pair 126 on the conveyance path 114. In a case of a continuous sheet feeding operation, after the trailing edge of the fed sheet P passes through the pickup roller 123, the CPU 201 de-energizes the solenoid 309 to move the pickup roller 123 down. As illustrated in FIG. 4C, the pickup roller 123 is brought into contact with a surface of the uppermost sheet (subsequent sheet) of the bundle of sheets 130.

Next, a sheet return operation after the occurrence of the sheet jam will be described. When the sheet return operation is started, the drive of the sheet feed motor 226 is first started to rotate the feed roller 124*b* in the direction opposite to the conveyance direction X, specifically, in a direction of returning the sheet P to the sheet container 120 at the rotation speed V (FIG. 4C). Although the retard roller 124*a* is driven so as to be rotated in the conveyance direction X, the retard roller 124*a* is rotated in the direction opposite to the conveyance direction X along with the movement of the sheet P or the rotation of the feed roller 124*b* held in contact with the retard roller 124*a* with the action of the torque limiter 303.

(Sheet Jam Detection Control)

Figures 5A, 5B:
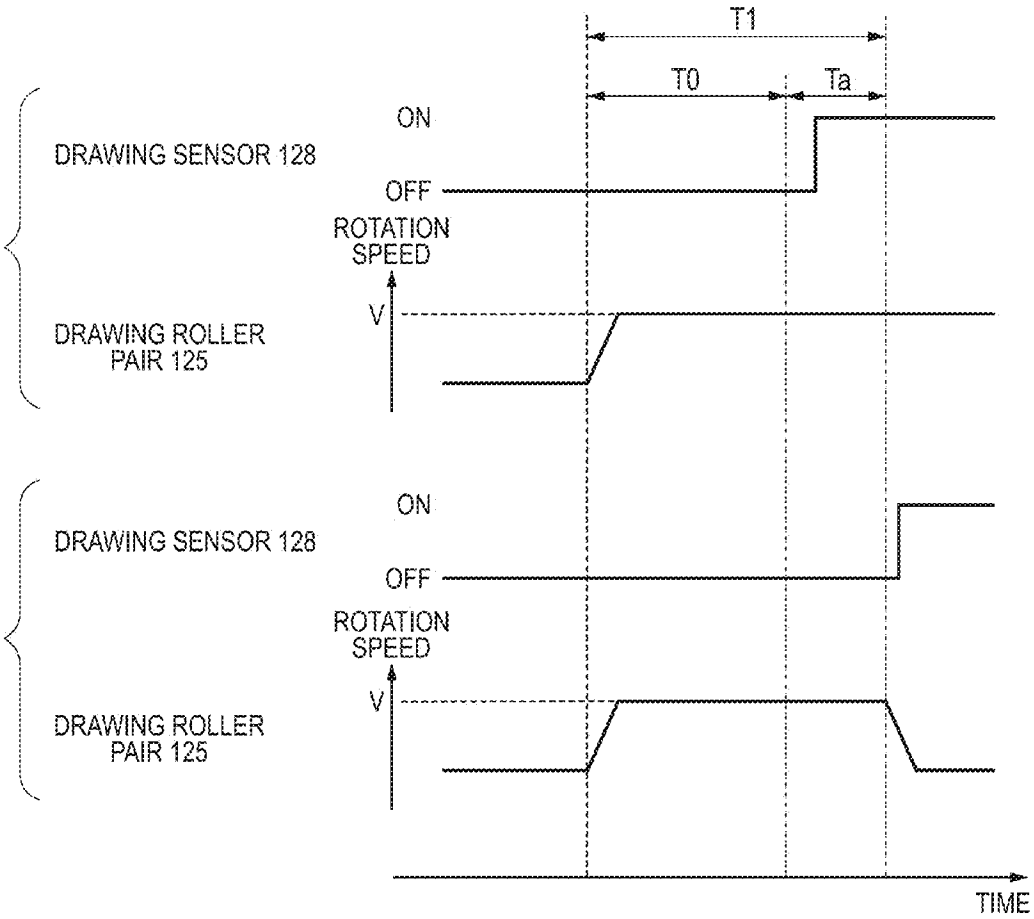
FIGS. 5A and 5B are timing charts for illustrating a detection signal of a drawing sensor and a rotation speed of a drawing roller pair.

Next, referring to FIG. 5A and FIG. 5B, sheet jam detection for the sheet P on the conveyance path 114 will be described. FIG. 5A and FIG. 5B are timing charts for illustrating a detection signal from the drawing sensor 128 and a rotation speed of the drawing roller pair 125. The drawing sensor (sheet detector) 128 is provided at a position of the drawing roller pair 125, or at a position downstream or upstream of the drawing roller pair 125 in the conveyance direction X for the sheet P. In FIG. 5A and FIG. 5B, the detection signal indicating that the drawing sensor 128 detects the sheet at the position (first predetermined position) of the drawing roller pair 125 is referred to as "ON state", whereas the detection signal indicating that the sheet is not detected is referred to as "OFF state". The detection of the sheet by the drawing sensor 128 at the position (first predetermined position) of the drawing roller pair 125 encompasses the detection of the sheet by the drawing sensor 128 not only at the position of the drawing roller pair 125 but also at the position downstream or upstream of the drawing roller pair 125. In the embodiment, there is described a case where the drawing sensor 128 detects the sheet at the position downstream of the drawing roller pair 125 in the conveyance direction X for the sheet P. The above-mentioned case is also encompassed in the detection of the sheet by the drawing sensor 128 at the position (first predetermined position) of the drawing roller pair 125. A distance between the position of the drawing roller pair 125 and the position where the drawing sensor 128 detects the sheet is preset. The distance is set so that the position where the drawing sensor 128 detects the sheet is closer to the position of the drawing roller pair 125 than the positions of the conveyance rollers other than the drawing roller pair 125.

FIG. 5A is a timing chart in a case where a sheet conveyance operation is performed normally. FIG. 5B is a timing chart in a case where the sheet conveyance operation is not normally performed due to occurrence of the sheet jam or the like. A time period T0 is a theoretical value calculated from a distance (mm) between the drawing roller pair 125 and the drawing sensor 128, and the rotation speed V (mm/sec) of the drawing roller pair 125. A time period Ta is a time period in which a delay in ON timing of the drawing sensor 128 is allowable. The time period Ta is determined by a sheet conveyance interval or the like, and is determined from a distance (mm) over which a delay is allowable and the rotation speed V (mm/sec) of the drawing roller pair 125. A time period T1 is reference time obtained by adding the time period Ta to the time period T0. The time period T1 is a reference value used to detect whether or not the sheet jam has occurred.

When the sheet feeding operation is started, the system controller 200 controls the drawing motor 225 to start the rotation of the drawing roller pair 125 and sets a timer for the time period T1 at the same time. The CPU 201 starts monitoring an ON/OFF state of the drawing sensor 128. The CPU 201 determines whether or not the drawing sensor 128 is brought into an ON state before the time period T1 set on the timer expires, based on the detection signal from the drawing sensor 128. As illustrated in FIG. 5A, when the drawing sensor 128 is brought into the ON state before the time period T1 set on the timer expires, it is determined that the conveyance of the sheet is performed normally. Therefore, the CPU 201 cancels the timer for the time period T1 and continues the conveyance of the sheet. On the other hand, when the time period T1 set on the timer expires before the drawing sensor 128 is brought into the ON state as illustrated in FIG. 5B, it is determined that the sheet jam has occurred. Therefore, the rotation of the drawing roller pair 125 is stopped.

In the embodiment illustrated in FIG. 5A and FIG. 5B, counting for the time period T1 is started simultaneously with the start of the rotation of the drawing roller pair 125. However, the start of counting for the time period T1 is not limited thereto. For example, the counting for the time period T1 may be started when the sheet feeding sensor 127 is changed from an OFF state into the ON state. The counting for the time period T1 may be started simultaneously with the start of the rotation of the pickup roller 123. Alternatively, the counting for the time period T1 may be started at predetermined time after any one of the above-mentioned times.

(Sheet Return Control Operation after Occurrence of Sheet Jam)

Next, a sheet return control operation when the sheet jam has occurred in the image forming apparatus 10 will be described. In the embodiment, the feed motor 226 is capable of rotating in both a forward direction and a reverse direction. Through rotation of the feed motor 226 in the reverse direction, the sheet feeding roller pair 124 is rotated in a direction of returning (conveying) the sheet to the sheet container 120. In short, the sheet feeding roller pair 124 is capable of conveying the sheet in the conveyance direction X and the direction opposite to the conveyance direction X. Meanwhile, the drawing motor 225 is capable of rotating only in the forward direction for conveying the sheet in the conveyance direction X. Therefore, the drawing motor 225 cannot rotate the drawing roller pair 125 in the direction of returning (conveying) the sheet to the sheet container 120. In short, the drawing roller pair 125 is capable of conveying the sheet only in the conveyance direction X.

The sheet feeding roller pair 124, the drawing roller pair 125, and the vertical conveyance roller pair 126 construct the sheet conveyer. The sheet roller pair 124 is capable of performing conveyance-direction switching control for switching the direction of conveying the sheet between the conveyance direction X and the direction opposite to the conveyance direction X. The drawing roller pair 125 is a conveyance roller pair positioned immediately downstream of the sheet feeding roller pair 124 in the conveyance direction X. In the sheet conveyer, the conveyance-direction switching control cannot be performed for the drawing roller pair 125 arranged downstream of the sheet feeding roller pair 124 for which the conveyance-direction switching control can be performed. The vertical conveyance roller pair 126 is arranged downstream of the drawing roller pair 125 in the conveyance direction X.

The vertical conveyance sensor (sheet detector) 129 is provided at the position of the vertical conveyance roller pair 126 serving as the conveyance portion or a position located downstream or upstream of the vertical conveyance roller pair 126 in the conveyance direction X. The vertical conveyance sensor 129 is configured to detect the sheet at the position (second predetermined position) of the vertical conveyance roller pair 126 to output a detection signal. The detection of the sheet by the vertical conveyance sensor 129 at the position (second predetermined position) of the vertical conveyance roller pair 126 encompasses the detection of the sheet by the vertical conveyance sensor 129 not only at the position of the vertical conveyance roller pair 126 but also at the position located downstream or upstream of the vertical conveyance roller pair 126. In the embodiment, a case where the vertical conveyance sensor 129 detects the sheet at the position located downstream of the vertical conveyance roller pair 126 in the conveyance direction X is described. The above-mentioned case is also encompassed in the detection of the sheet by the vertical conveyance sensor 129 at the position (second predetermined position) of the vertical conveyance roller pair 126.

Figure 6:
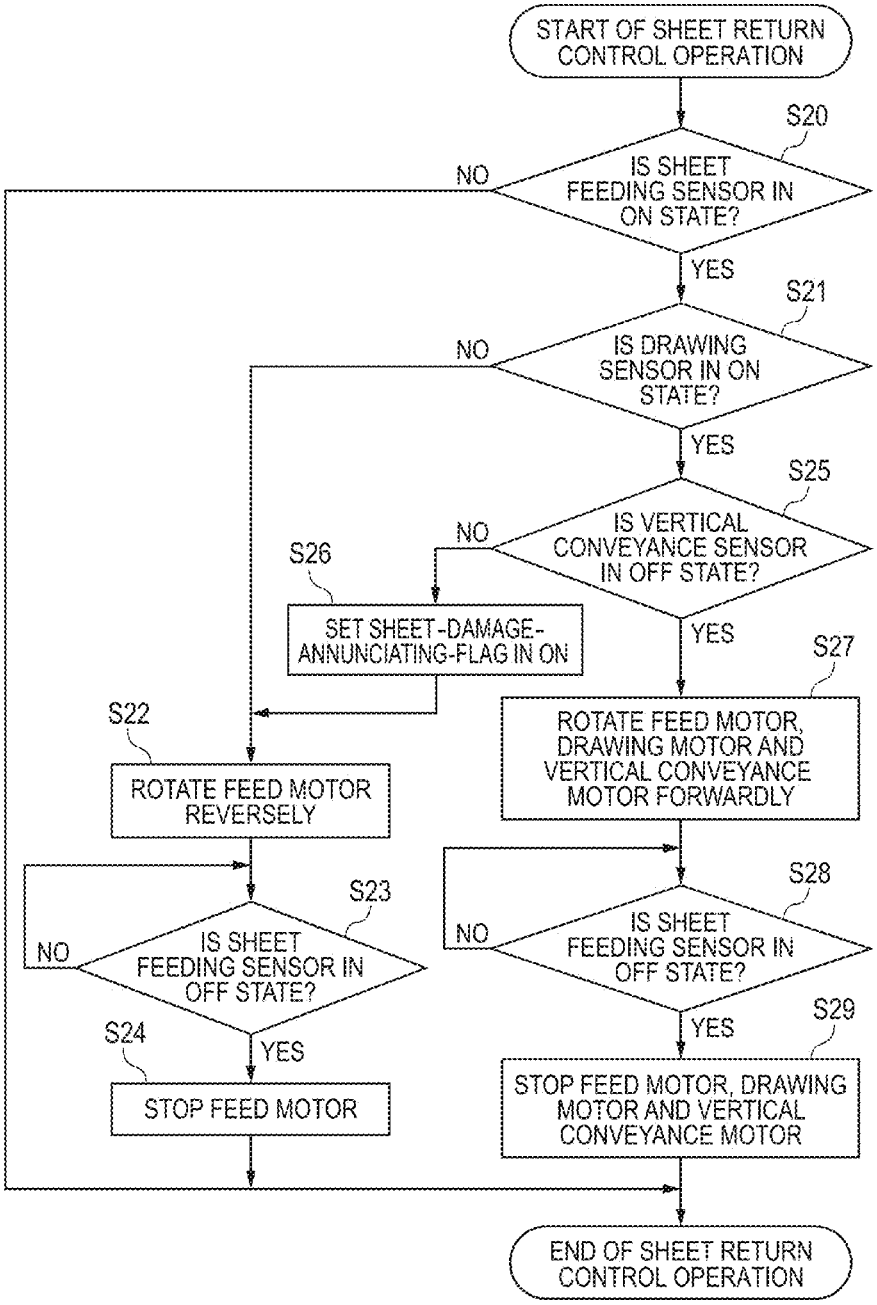
FIG. 6 is a flowchart for illustrating a sheet return control operation executed by a CPU when a sheet jam occurs.

FIG. 6 is a flowchart for illustrating the sheet return control operation executed by the CPU 201 after the occurrence of the sheet jam. The CPU 201 executes the sheet return control operation based on the program stored in the ROM 202. When the sheet jam occurs in the image forming apparatus 10 (YES in Step S3 of FIG. 8 referred to later), the sheet return control operation is started (Step S4 of FIG. 8 referred to later). The sheet closest to the sheet container 120 at the time of occurrence of the sheet jam is referred to as a first sheet P1. The CPU 201 determines whether or not a leading edge of the first sheet P1 has reached the sheet feeding roller pair 124, based on the detection signal from the sheet feeding sensor 127. Specifically, when the leading edge of the first sheet P1 reaches the sheet feeding roller pair 124, the detection signal of the sheet feeding sensor 127 is brought into the ON state. In this regard, the CPU 201 determines whether or not the detection signal of the sheet feeding sensor 127 is in the ON state (Step S20). When the detection signal of the sheet feeding sensor 127 is not in the ON state (NO in Step S20), the CPU 201 ends the sheet return control operation. In this case, the leading edge of the first sheet P1 has not reached the sheet feeding roller pair 124. Therefore, a position of the stopped first sheet P1 is left unchanged.

When the detection signal of the sheet feeding sensor 127 is in the ON state (YES in Step S20), the CPU 201 determines whether or not the leading edge of the first sheet P1 has reached the drawing roller pair 125 based on the detection signal of the drawing sensor 128. Specifically, when the leading edge of the first sheet P1 reaches the drawing roller pair 125, the detection signal of the drawing sensor 128 is brought into the ON state. In this regard, the CPU 201 determines whether or not the detection signal of the drawing sensor 128 is in the ON state (Step S21). When the detection signal of the drawing sensor 128 is not in the ON state (NO in Step S21), the CPU 201 rotates the feed motor 226 reversely to rotate the sheet feeding roller pair 124 in the direction of conveying the first sheet P1 to the sheet container 120 (Step S22). At this time, the pickup roller 123 is moved up, and is therefore spaced away from the uppermost surface of the bundle of sheets 130.

Figure 7A:
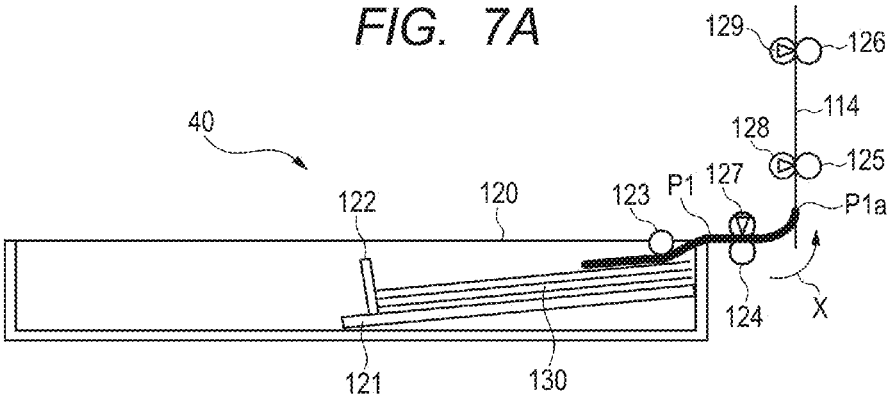
FIGS. 7A, 7B and 7C are views for illustrating a position of a first sheet in a sheet feeding portion.
Figure 7B:
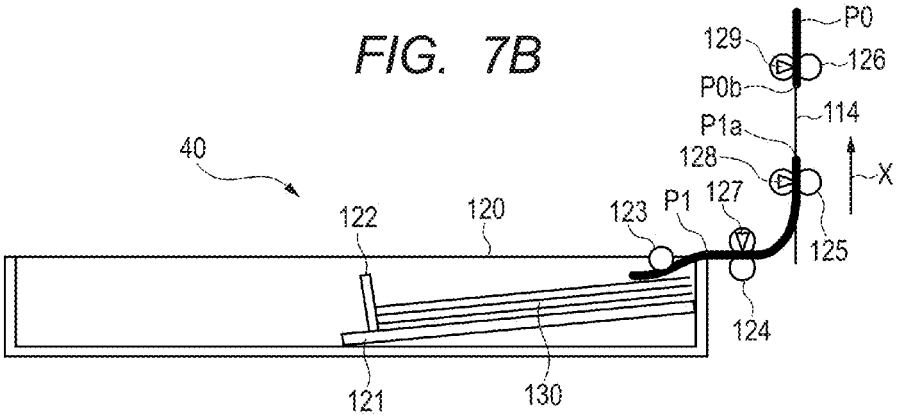
Figure 7C:
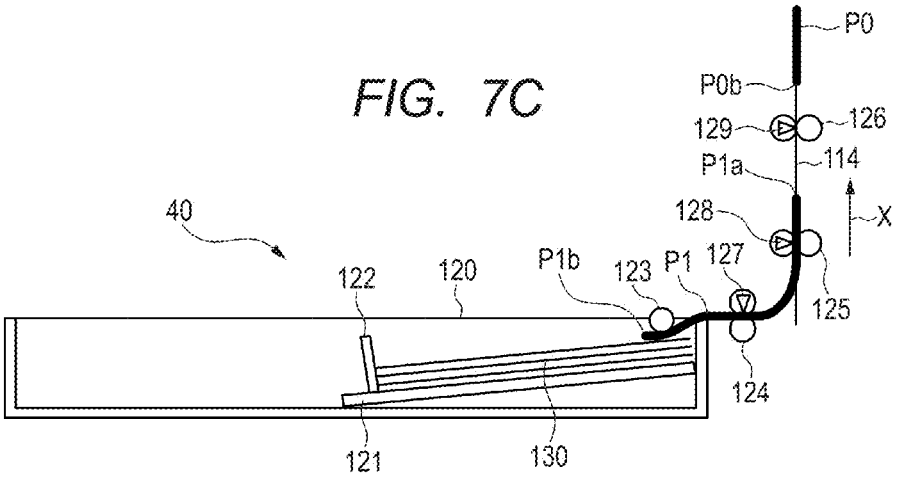

FIG. 7A, FIG. 7B, and FIG. 7C are views for illustrating a position of the first sheet P1 in the sheet feeding portion 40. FIG. 7A is a view for illustrating the sheet feeding portion 40 in a case where a leading edge P1*a* of the first sheet P1 has reached the sheet feeding roller pair 124 and the leading edge P1*a* of the first sheet P1 has not reached the drawing roller pair 125. After the sheet feeding roller pair 124 is rotated in the direction of conveying the first sheet P1 to the sheet container 120 in Step S22, the CPU 201 determines whether or not the leading edge P1*a* of the first sheet P1 (trailing edge of the sheet P1 fed in the direction opposite to the conveyance direction X) has passed through the sheet feeding roller pair 124. Specifically, after the leading edge P1*a* of the first sheet P1 passes through the sheet feeding roller pair 124, the detection signal of the sheet feeding sensor 127 is brought into the OFF state. In this regard, the CPU 201 determines whether or not the detection signal of the sheet feeding sensor 127 is in the OFF state (Step S23). When the detection signal of the sheet feeding sensor 127 is in the OFF state (YES in Step S23), the CPU 201 stops the feed motor 226 to stop the rotation of the sheet feeding roller pair 124 (Step S24). Then, the CPU 201 ends the sheet return control operation.

On the other hand, when the detection signal of the drawing sensor 128 is in the ON state (YES in Step S21), the CPU 201 determines whether or not a trailing edge P0*b* of a second sheet (preceding sheet) P0 preceding the first sheet P1 has passed through the vertical conveyance roller pair 126. The second sheet P0 is positioned downstream of the first sheet P1 in the conveyance direction X. Specifically, after the trailing edge P0*b* of the second sheet P0 passes through the vertical conveyance roller pair 126, the detection signal of the vertical conveyance sensor 129 is brought into the OFF state. In this regard, the CPU 201 determines whether or not the detection signal of the vertical conveyance sensor 129 is in the OFF state (Step S25). When the detection signal of the vertical conveyance sensor 129 is not in the OFF state (No in Step S25), the CPU 201 sets a sheet-damage-annunciating-flag in on (Step S26). The sheet-damage-annunciating-flag will be described later.

FIG. 7B is a view for illustrating the sheet feeding portion 40 in a case where the leading edge P1*a* of the first sheet P1 has reached the drawing roller pair 125 and the trailing edge P0*b* of the second sheet P0 has not passed through the vertical conveyance roller pair 126. After the paper-damage-annunciating-flag is set in on, the CPU 201 rotates the feed motor 226 reversely to rotate the sheet feeding roller pair 124 in the direction of conveying the first sheet P1 to the sheet container 120 (Step S22). As described above, in the embodiment, the drawing roller pair 125 cannot be rotated in the direction of conveying the first sheet P1 to the sheet container 120. Therefore, when the sheet feeding roller pair 124 returns the first sheet P1 to the sheet container 120, there is a possibility that a roller mark may be left on a portion of the first sheet P1, which is in contact with the drawing roller pair 125. Therefore, the CPU 201 sets the sheet-damage-annunciating-flag in on as described above. When the CPU 201 determines that the leading edge P1*a* of the first sheet P1 (trailing edge of the sheet P1 fed in the direction opposite to the conveyance direction X) has passed through the sheet feeding roller pair 124 (YES in Step S23), the CPU 201 stops the rotation of the sheet feeding roller pair 124 (Step S24). Then, the CPU 201 ends the sheet return control operation.

On the other hand, when the detection signal of the vertical conveyance sensor 129 is in the OFF state (YES in Step S25), the CPU 201 rotates the feed motor 226, the drawing motor 225, and the vertical conveyance motor 227 forwardly (Step S27). FIG. 7C is a view for illustrating the sheet feeding portion 40 in a case where the leading edge P1*a* of the first sheet P1 has reached the drawing roller pair 125 and the trailing edge P0*b* of the second sheet P0 has passed through the vertical conveyance roller pair 126. Through the forward rotation of the feed motor 226, the drawing motor 225, and the vertical conveyance motor 227, the sheet feeding roller pair 124, the drawing roller pair 125, and the vertical conveyance roller pair 126 convey the first sheet P1 in the normal conveyance direction X. The CPU 201 determines whether or not the trailing edge P1*b* of the first sheet P1 has passed through the sheet feeding sensor 127. Specifically, after the trailing edge P1*b* of the first sheet P1 passes through the sheet feeding sensor 127, the detection signal of the sheet feeding sensor 127 is brought into the OFF state. In this regard, the CPU 201 determines whether or not the detection signal of the sheet feeding sensor 127 is in the OFF state (Step S28). When the detection signal of the sheet feeding sensor 127 is in the OFF state (YES in Step S28), the CPU 201 stops the feed motor 226, the drawing motor 225, and the vertical conveyance motor 227 to stop the sheet feeding roller pair 124, the drawing roller pair 125, and the vertical conveyance roller pair 126 (Step S29). The CPU 201 ends the sheet return control operation.

(Display Control Operation of Operating Portion after Occurrence of Sheet Jam)

Figure 8:
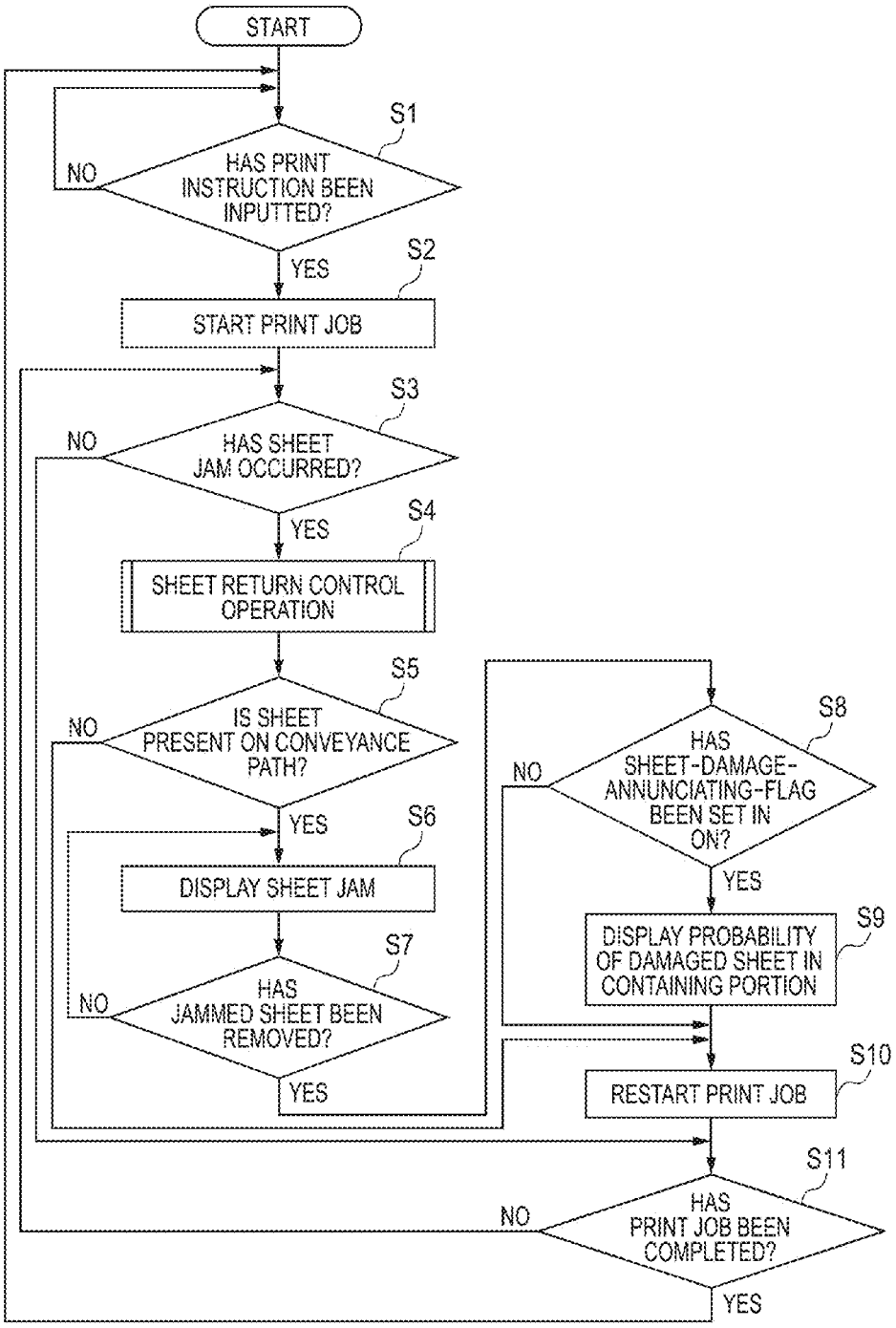
FIG. 8 is a flowchart for illustrating a display control operation executed by the CPU when the sheet jam occurs.

Next, referring to FIG. 8, an example of a display control operation of the operating portion 20 when the sheet jam occurs during the image formation will be described. FIG. 8 is a flowchart for illustrating the display control operation executed by the CPU 201 at the time of occurrence of the sheet jam. The CPU 201 executes the display control operation based on the program stored in the ROM 202.

The CPU 201 determines whether or not the print instruction has been input from the operating portion 20 or the external device, e.g., the PC (not shown) (Step S1). When the print instruction is input (YES in Step S1), the CPU 201 accepts the print job to start the print job (Step S2). The CPU 201 determines whether or not the sheet jam has occurred during the execution of the print job, based on a result of detection by the sensor signal reading portion 224 (Step S3). When it is determined that the sheet jam has not occurred (NO in Step S3), the CPU 201 then determines whether or not the print job has been completed (Step S11). When it is determined that the print job has not been completed (NO in Step S11), the processing returns to Step S3. On the other hand, when it is determined that the print job has been completed (YES in Step S11), the processing returns to Step S1 where the CPU 201 waits for input of a subsequent print instruction.

Figure 9A:
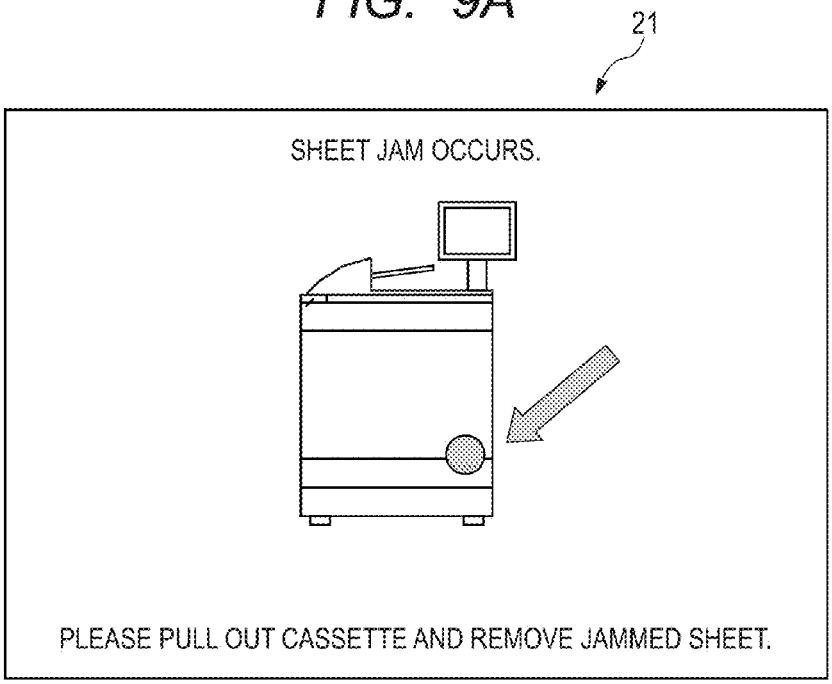
FIGS. 9A and 9B are views for illustrating examples of a screen displayed on a display portion of an operating portion.
Figure 9B:
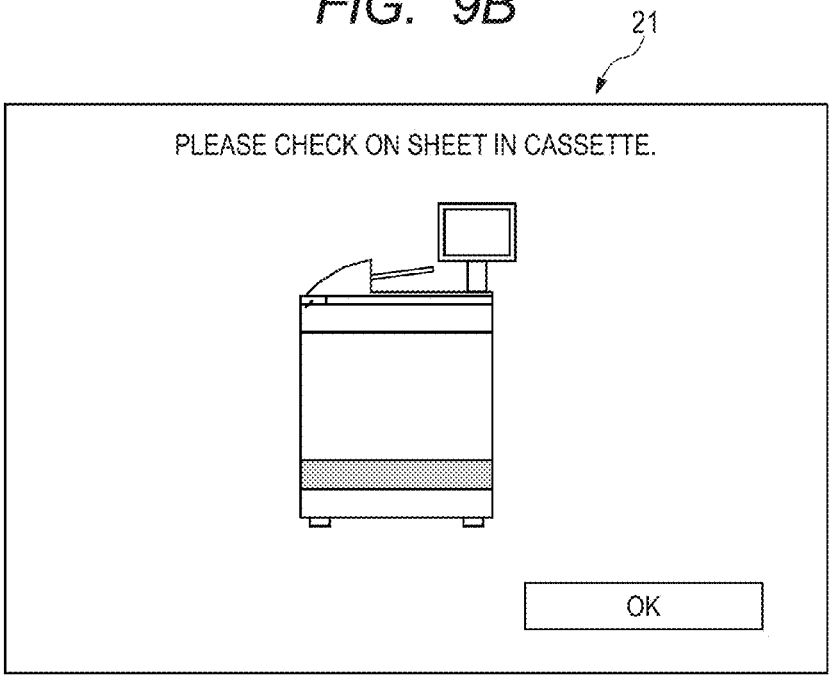

When it is determined that the sheet jam has occurred during the execution of the print job (YES in Step S3), the CPU 201 executes the above-mentioned sheet return control operation at the time of occurrence of the sheet jam (Step S4). After the execution of the sheet return control operation, the CPU 201 determines whether or not the sheet is present on the conveyance path 114, based on the result of detection by the sensor signal reading portion 224 (Step S5). When it is determined that the sheet is not present on the conveyance path 114 (NO in Step S5), the processing proceeds to Step S10. Then, the CPU 201 restarts the print job (Step S10). On the other hand, when it is determined that the sheet is present on the conveyance path 114 (YES in Step S5), the CPU 201 displays the occurrence of the sheet jam on the operating portion 20 to annunciate the need to remove the jammed sheet to the user (Step S6). FIG. 9A and FIG. 9B are views for illustrating examples of a screen displayed on the display portion 21 of the operating portion 20. FIG. 9A is a view for illustrating an example of the screen of the display portion 21 configured to annunciate the occurrence of the sheet jam.

Next, the CPU 201 determines whether or not all the jammed sheets have been removed, based on the result of detection by the sensor signal reading portion 224 (Step S7). When it is determined that the jammed sheets have not all been removed (NO in Step S7), the processing returns to Step S6. On the other hand, when it is determined that the jammed sheets have all been removed (YES in Step S7), the CPU 201 determines whether or not the sheet-damage-annunciating-flag has been set in on (Step S8). When the sheet-damage-annunciating-flag is set in on, there is a possibility of damage on the sheet returned to the sheet container 120 through the sheet return control operation. When the damaged sheet is used for the print job, there is a possibility of occurrence of an image defect or conveyance failure. Therefore, it is necessary to urge the user to check whether or not the sheet has been damaged to prevent the damaged sheet from being used. Therefore, when it is determined that the sheet-damage-annunciating-flag has been set in on (YES in Step S8), the possibility of occurrence of the damage on the sheet contained in the sheet container 120 is displayed on the display portion 21 of the operating portion 20 (Step S9). The operating portion 20 functions as an annunciator configured to annunciate the need to check the sheets contained in the sheet container 120 to the user. FIG. 9B is a view for illustrating an example of the screen of the display portion 21 configured to annunciate the possibility of occurrence of the damage on the sheet contained in the sheet container 120. The processing proceeds to Step S10 where the CPU 201 restarts the print job. On the other hand, when it is determined that the sheet-damage-annunciating-flag has not been set in on (NO in Step S8), the processing proceeds to S10 where the CPU 201 restarts the print job.

Next, the CPU 201 determines whether or not the print job has been completed (Step S11). When it is determined that the print job has not been completed (NO in Step S11), the processing returns to Step S3. On the other hand, when it is determined that the print job has been completed (YES in Step S11), the processing returns to Step S1 where the CPU 201 waits for input of the subsequent print job.

According to the embodiment, the damaged sheet can be prevented from being used for the image formation. Therefore, the occurrence of the image defect and the conveyance failure can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-245178, filed Dec. 16, 2015, which is hereby incorporated by reference herein in its entirety.

What is claimed is:

1. An image forming apparatus, comprising:

a sheet container configured to contain a sheet;

an image forming portion configured to form an image on the sheet;

a first sheet conveyer disposed at a first position and configured to convey the sheet in a conveyance direction from the sheet container to the image forming portion on a conveyance path between the sheet container and the image forming portion, the first sheet conveyor configured to convey the sheet in the conveyance direction and in a direction opposite to the conveyance direction;

a second sheet conveyer disposed at a second position downstream of the first sheet conveyer and configured to convey the sheet conveyed by the first sheet conveyer in the conveyance direction but not to convey the sheet in the direction opposite to the conveyance direction;

a first sheet detector configured to detect a sheet located at the first position;

a second sheet detector configured to detect a sheet located at the second position;

a third sheet detector configured to detect a sheet located at a third position downstream, in the conveyance direction, of the second sheet detector; and a controller configured to control a sheet conveyance, wherein, in a case where the first sheet detector detects the sheet, the second sheet detector detects the sheet, and the third sheet detector does not detect the sheet when the sheet conveyance is stopped by the controller, the controller controls the first sheet conveyer and the second sheet conveyer so that the sheet which has been detected by the first sheet detector is conveyed in the conveyance direction, and wherein, in a case where the first sheet detector detects the sheet and the second sheet detector does not detect the sheet when the sheet conveyance is stopped by the controller, the controller controls the first sheet conveyer so that the sheet which has been detected by the first sheet detector is conveyed in the direction opposite to the conveyance direction so as to be returned to the sheet container.

2. An image forming apparatus according to claim 1, wherein, in a case where the first sheet detector detects the sheet, the second sheet detector detects the sheet, and the third sheet detector detects the sheet when the sheet conveyance is stopped by the controller, the controller controls the first sheet conveyer so that the sheet which has been detected by the first sheet detector is conveyed in the direction opposite to the conveyance direction so as to be returned to the sheet container.

3. An image forming apparatus according to claim 2, further comprising an annunciator configured to annunciate information, wherein, after the sheet which has been detected by the first sheet detector is conveyed in the direction opposite to the conveyance direction so as to be returned to the sheet container, the controller causes the annunciator annunciate prompting a user to check the sheet in the sheet container.

4. An image forming apparatus according to claim 1, further comprising a third conveyer configured to convey the sheet located at the third position.

5. An image forming apparatus, comprising:

a sheet container configured to contain a sheet;

an image forming portion configured to form an image on the sheet;

a first sheet conveyer disposed at a first position and configured to convey the sheet in a conveyance direction from the sheet container to the image forming portion on a conveyance path between the sheet container and the image forming portion, the first sheet conveyor configured to convey the sheet in the conveyance direction and in a direction opposite to the conveyance direction;

a second conveyer disposed at a second position downstream of the first sheet conveyer and configured to convey the sheet conveyed by the first sheet conveyer in the conveyance direction but not to convey the sheet in the direction opposite to the conveyance direction;

a first sheet detector configured to detect a sheet located at the first position;

a second sheet detector configured to detect a sheet located at the second position;

a third sheet detector configured to detect a sheet located at a third position downstream, in the conveyance direction, of the second sheet detector; and a controller configured to control a sheet conveyance, wherein, in a case where the first sheet detector detects the sheet, the second sheet detector detects the sheet, and the third sheet detector does not detect the sheet when the sheet conveyance is stopped by the controller, the controller controls the first sheet conveyer and the second sheet conveyer so that the sheet which has been detected by the first sheet detector is conveyed in the conveyance direction, and wherein in a case where the first sheet detector detects the sheet, the second sheet detector detects the sheet, and the third sheet detector detects the sheet when the sheet conveyance is stopped by the controller, the controller controls the first sheet conveyer so that the sheet which has been detected by the first sheet detector is conveyed in the direction opposite to the conveyance direction so as to be returned to the sheet container and issues a warning to prompt a user to check the sheet returned to the sheet container.

6. An image forming apparatus according to claim 5, wherein, in a case where the first sheet detector detects the sheet and the second sheet detector does not detect the sheet when the sheet conveyance is stopped by the controller, the controller controls the first sheet conveyer so that the sheet which has been detected by the first sheet detector is conveyed in the direction opposite to the conveyance direction so as to be returned to the sheet container.

7. An image forming apparatus according to claim 5, further comprising a third conveyer configured to convey the sheet located at the third position.

8. An image forming apparatus according to claim 1, wherein the controller is further configured to determine when a sheet jam has occurred, and wherein, in a case where the controller determines that the sheet jam has occurred, the controller stops the sheet conveyance and determines detection results of the first sheet detector, the second sheet detector and the third sheet detector.

9. An image forming apparatus according to claim 5, wherein the controller is further configured to determine when a sheet jam has occurred, and wherein, in a case where the controller determines that the sheet jam has occurred, the controller stops the sheet conveyance and determines detection results of the first sheet detector, the second sheet detector and the third sheet detector.

* * * * *